US008739443B2

(12) United States Patent
Gold et al.

(10) Patent No.: US 8,739,443 B2
(45) Date of Patent: Jun. 3, 2014

(54) DISPLAY DEVICE FOR TRANSPORTATION VECHICLES

(71) Applicants: Michael Gold, Portland, OR (US); Frank Rego, Portland, OR (US)

(72) Inventors: Michael Gold, Portland, OR (US); Frank Rego, Portland, OR (US)

(73) Assignee: Swypers, LLC, Portland, OR (US)

( * ) Notice: Subject to any disclaimer, the term of this patent is extended or adjusted under 35 U.S.C. 154(b) by 0 days.

(21) Appl. No.: 14/035,816

(22) Filed: Sep. 24, 2013

(65) Prior Publication Data

US 2014/0020272 A1 Jan. 23, 2014

Related U.S. Application Data

(63) Continuation-in-part of application No. 13/415,103, filed on Mar. 8, 2012.

(60) Provisional application No. 61/452,727, filed on Mar. 15, 2011.

(51) Int. Cl.
*G09F 21/04* (2006.01)

(52) U.S. Cl.
USPC ..... 40/591; 24/656

(58) Field of Classification Search
USPC ..... 24/324, 68 E, 310, 313; 248/475.1; 40/591–594, 611.06–611.08, 649, 652, 40/653, 56, 76, 90, 114, 115, 122
See application file for complete search history.

(56) References Cited

U.S. PATENT DOCUMENTS

| | | | | | |
|---|---|---|---|---|---|
| 2,387,953 | A * | 10/1945 | Terry | 340/481 |
| 2,799,887 | A | 7/1957 | Nemic | |
| 3,231,951 | A | 2/1966 | De Armond | |
| 4,184,277 | A | 1/1980 | Larin | |
| 4,296,532 | A * | 10/1981 | Ho | 24/326 |
| 4,675,955 | A * | 6/1987 | Nakamura | 24/656 |
| 5,144,725 | A * | 9/1992 | Krauss | 24/625 |
| 5,170,539 | A * | 12/1992 | Lundstedt et al. | 24/196 |
| 5,191,685 | A * | 3/1993 | Aoki et al. | 24/656 |
| 5,360,282 | A * | 11/1994 | Nagengast et al. | 403/131 |
| 5,409,332 | A | 4/1995 | Chabot, Jr. et al. | |
| 5,653,548 | A * | 8/1997 | Amdahl | 403/133 |
| 5,715,620 | A | 2/1998 | Walker | |
| 5,771,618 | A | 6/1998 | Burke | |
| 5,933,991 | A | 8/1999 | Gaul | |
| 6,308,445 | B1 | 10/2001 | Porraro | |
| 6,922,929 | B1 * | 8/2005 | Schramek | 40/591 |
| 7,513,074 | B2 * | 4/2009 | Glenn et al. | 40/649 |
| 8,336,241 | B2 * | 12/2012 | Rowland et al. | 40/649 |
| 8,371,053 | B2 * | 2/2013 | Tang | 40/648 |
| 2004/0231215 | A1 * | 11/2004 | Caveney et al. | 40/642.02 |
| 2005/0204516 | A1 * | 9/2005 | Leva et al. | 24/385 |

* cited by examiner

*Primary Examiner* — Shin Kim

(57) ABSTRACT

Disclosed herein is a display device for use on transportation vehicles which can be easily altered or removed by the user. The display device contains a mounting bracket which can be releasably attached to the vehicle and a display which may be permanently or releasably attached to the mounting bracket.

13 Claims, 8 Drawing Sheets

DISPLAY DEVICE FOR TRANSPORTATION VECHICLES

RELATED APPLICATIONS

This application claims priority to U.S. patent application Ser. No. 13/415,103 filed Mar. 8, 2012, which claims the benefit of U.S. Provisional Patent Application No. 61/452,727 filed Mar. 15, 2011 both of which are incorporated herein by reference in their entirety.

TECHNICAL FIELD

The present invention relates to display devices. Specifically, the present invention relates to display devices attached to wheeled conveyances.

BACKGROUND OF THE INVENTION

Transportation vehicles are frequently a means of self-expression, regardless of the type of vehicle (motorized or unmotorized). Particular models, styles, colors, or manufacturers are marketed to and purchased by particular categories or types of individuals. However, with mass produced goods, there is a limit to the amount of personalization that can be done prior to a sale. Once purchased, vehicles are frequently further personalized through the use of bumper stickers, vanity plates, antennae balls, magnets and decals. Such items are used to convey a variety of messages or statements about an individual whether it is a particular set of beliefs, opinions, political leanings, affiliations, jokes, business information, support for a cause, or other such information.

Bumper stickers, vanity plates, antennae balls, magnets and decals all have differing degrees of visibility, interchangability, and permanence and thus different advantages and disadvantages which make them more or less suitable for personalization of a vehicle. Bumper stickers are inexpensive and widely available, but they are difficult to remove completely without damaging the finish of a vehicle and therefore frequently remain on a vehicle even when they are faded, out of date, or otherwise obsolete. Magnets and decals are easier to remove, but correspondingly do not always remain where they are placed and can be difficult to read from a distance. They additionally require a smooth surface, limiting their placement and visibility. Antennae balls are small and require that someone recognize the symbol in order for a message to be conveyed. Vanity plates are expensive and the type and length of the message that can be included is limited. License plate holders are small and difficult to read. Additionally, vanity plates, license plate holders and bumper stickers are generally displayed below eye level, decreasing the visibility and impact of a particular message. Writing messages on the car using glass marker, shoe polish, wax, or soap or window paint is messy, difficult to do well, and does not withstand the elements.

There is therefore an unmet need for a means of displaying a message, logo, and/or graphical image which is visible to others, stays in place until removed, and which can be easily removed or altered at the user's discretion.

SUMMARY OF EXEMPLARY EMBODIMENTS

Provided herein is a display device for displaying a written and/or graphical message on a wheeled conveyance including, but not limited to, a car, a bicycle, a moped, a motorized bicycle, a bike trailer, a motor home, a cargo box, a trailer, a bike rack, a truck, a motorcycle, a wagon, a stroller, a baby carriage, motor scooter, a camper, a snowmobile, or a cart such that the written and/or graphical message is visible to those not riding in or on the vehicle and which can be easily removed or altered at the wheeled conveyance owner's discretion. The display device may be stationary or mobile and may be attached to any part of the wheeled conveyance including, but not limited to, a rear windshield wiper, a front windshield wiper, a headlamp wiper, an antenna, a post, a seat rail, frame, attached box or other part of the wheeled conveyance. In some embodiments, the display device is attached to a stationary part of the wheeled conveyance. In other embodiments, the display device may be attached to an independently moving part of a wheeled conveyance such as a rear windshield wiper.

The display for the written and/or graphical message may be any shape or material desired. In some embodiments it is a flat surface, in other embodiments it is multi-dimensional. In some embodiments it may be rigid, in other embodiments, it may be more flexible. In some embodiments it is a standard shape such as a rectangle, circle or square. In further embodiments, the display is shaped to match the message, graphics and/or logo depicted on the display. Messages, graphics and/or logos may be imprinted on, displayed on, part of, or otherwise attached to a first side of the display. In some embodiments, the message may be enhanced visually using three dimensional, lenticular, or reflective materials. The message may be altered in myriad ways when desired. In some embodiments, the display may be interchanged for another display when the user desires to change the message on the display. In other embodiments, graphical and/or written messages may be fastened to the display, either replacing or on top of the previous message. In yet another embodiment, graphical and/or written messages may be printed or written directly on the display by the user. In a further embodiment, the message may be displayed or altered electronically, i.e. the message may be composed using LEDs, LCD, plasma technology or other electronic forms. In other embodiments, the message may be enhanced visually using three dimensional, lenticular, or reflective materials A second side of the display on the back or opposite side of the first side of the display is attached to an attachment point of a wheeled conveyance. In some embodiments, the display device is fastened directly to one or more attachment points of a wheeled conveyance through attachment sites on the display using any means generally used including, but not limited to, nuts, nails, pins, screws, bolts, adhesives, cables, plastic ties, plastic cables, zip ties, multi-purpose ties, tapes, elastic bands, clips, Velcro®, clamps, rivets, wire, string, soldering, a sleeve, or a combination thereof. In other embodiments, the display device may comprise a display and a mounting bracket. The mounting bracket may consist of one or more pieces which may be flexible or rigid. In some embodiments the mounting bracket may wrap around the attachment point of the wheeled conveyance. In other embodiments, the mounting bracket may sit flat against the attachment point of the wheeled conveyance. In yet another embodiment, the mounting bracket may contain a groove for the attachment point of the wheeled conveyance. In some embodiments, the mounting bracket may be attached to the wheeled conveyance using a backing bracket placed behind an attachment point such as a windshield wiper. In other embodiments, the mounting bracket may be attached to the wheeled conveyance using a spacer between the mounting bracket and an attachment point. In additional embodiments, the mounting bracket may comprise multiple joined parts, one of which is attached to the display and a second which is attached to the wheeled conveyance. In some embodiments, the parts of the mounting bracket may rotate clockwise or counterclockwise in relation to each other to aid in attaching the display to a vehicle. They may rotate about 45°, 90°, 180°, 225° or 360° or any fraction thereof along the same plane in relation to each other, i.e. clockwise or counterclockwise.

The mounting bracket may be attached to the wheeled conveyance at attachment sites by any means generally used including, but not limited to, nuts, nails, pins, screws, bolts, adhesives, cables, plastic ties, plastic cables, zip ties, multipurpose ties, tapes, elastic bands, clips, Velcro®, clamps, rivets, wire, string, soldering, a sleeve, or a combination thereof. The mounting bracket may be attached at one or more points, such as two, three, four or more points to the wheeled conveyance. In some embodiments, the mounting bracket is attached to the wheeled conveyance such that it may be removed from the wheeled conveyance by the user when desired. In other embodiments, the mounting bracket is permanently attached to the wheeled conveyance. In additional embodiments, the attachment mechanism for the mounting bracket may be adjustable, allowing the attachment mechanism to be tightened or loosened as needed. For example, in some embodiments, the attachment mechanism may comprise a ratcheting device.

The attachment between the mounting bracket and the display may be permanent or temporary. In some embodiments, the display and mounting bracket may be joined together using a joint, side release buckle, bayonet clip or other similar device including but not limited to, hooks and loop type fasteners, clasps, buckles, zippers, snaps, buttons, magnets, screws, nuts and bolts, adhesives, releasable adhesives or other suitable fasteners. For example, in some embodiments, the mounting bracket may comprise a bayonet clip, side release buckle, quick release clip, or other useful connector. In some embodiments, the mounting bracket may comprise spring arms biased to the out position which when depressed can slide into rails on the display and lock in place. In some embodiments, one or more of the spring arms may have a retaining block that terminates on the front end of the spring arms and helps lock the arms in place. In other embodiments, the retaining block on the spring arms may lock around a stop mechanism on the display. In further embodiments, there may be additional retaining blocks on the display to prevent the mounting bracket from sliding too far forward.

In another embodiment, the attachment between the mounting bracket and the display may be a joint including, but not limited to, a ball and socket joint, a screw joint, pin joint, hinge, swivel joint, ball detent, a bolted joint, a welded joint, hirth joint, or revolute joint. In some embodiments, the joint may be a separate piece or pieces that attach to the display and/or mounting bracket; in other embodiments, the joint or piece(s) of the joint may be part of the display and/or mounting bracket. In embodiments where the joint is separate from the display and/or mounting bracket, the one or more pieces of the joint may attach to the display and/or mounting bracket by any means generally used. In some embodiments a part of the joint may thread through the display and/or mounting bracket, may snap onto the display and/or mounting bracket, may screw into the display and/or mounting bracket, may be glued to the display and/or mounting bracket, may attach using a locking mechanism, for example a screw-threaded type, a bayonet-type, or a friction lock type of locking mechanism, or attach by any other means generally used. In some embodiments, the display device is attached to the wheeled conveyance both directly and through the use of the mounting bracket.

In some embodiments, the attachment between the mounting bracket and the display may allow the display to pivot, rotate and/or tilt to achieve the desired viewing angle for the display. The amount of rotation of the display may be any amount up to and including 360°. The display may additionally pivot or tilt +/− about 5 to +/− about 45 degrees in relation to the windshield wiper and/or mounting bracket so that it is perpendicular to the street, regardless of the angle of the attachment point. Once the display device is placed at the desired angle, it maintains its orientation until it is altered by the user. In additional embodiments, the display device rotates to maintain its position relative to the road surface regardless of the motion of the wheeled conveyance or attachment point.

The foregoing and other objects, features, aspects and advantages of the present invention will become more apparent from the following sections.

DETAILED DESCRIPTION OF EXEMPLARY EMBODIMENTS

Figure 1:
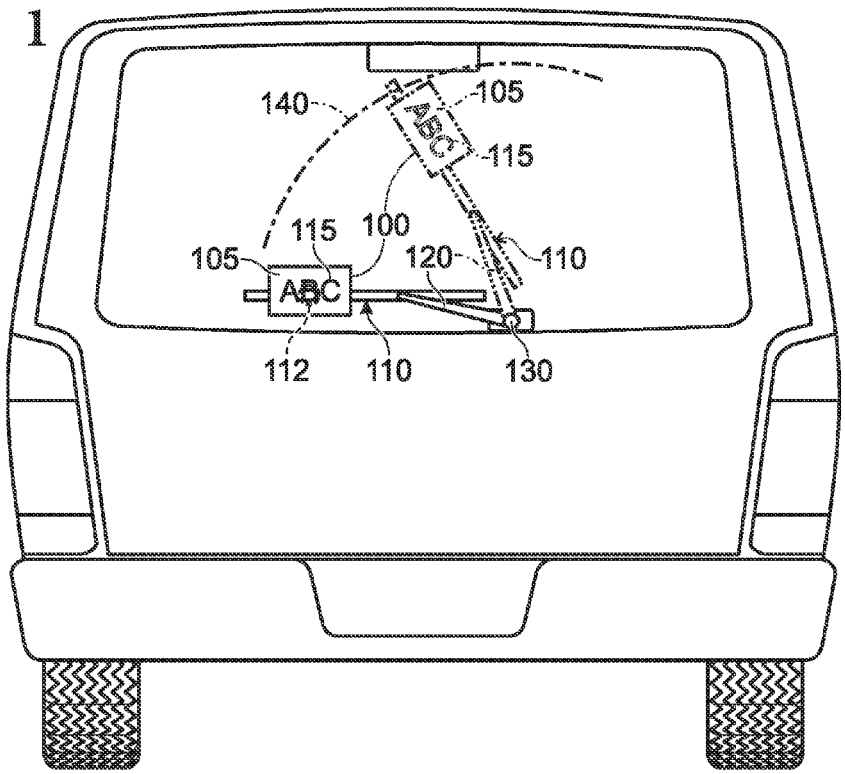
FIG. 1 shows a view of an embodiment of a display device mounted on the rear windshield wiper of a motorized vehicle.

Referring now in more detail to the drawings, in FIG. 1, an embodiment of the display device is shown generally at 100. The display device 100 comprises a display 105 and an attachment mechanism 112.

The display device 100 may be attached at any point on a wheeled conveyance including, but not limited to, a rear windshield wiper, a front windshield wiper, a headlamp wiper, post, an antenna, seat rails, the frame, the luggage rack, or seat post. In FIG. 1, the display device is permanently or removably attached to a wiper arm 110 which is part of a wiper assembly 120. Wiper assembly 120 includes wiper arm 110 which is pivotally connected at 130 to a wiper motor (not shown) such that when the wiper arm 110 moves in the arc 140, the display device 100 moves with it. In some embodiments the display device 100 may pivot so that it maintains an upright position perpendicular to the road, regardless of the movement of the wiper arm 110.

The display 105 may be directly attached to the wiper arm 110 using an attachment mechanism 112 attached to an attachment site (not shown) on the display or may be attached to the wiper arm 110 through a mounting bracket (not shown). The attachment mechanism 112 may be any means generally used, including, but not limited to, nuts, pins, nails, screws, bolts, adhesives, cables, plastic ties, zip ties, multi-purpose ties, tapes, elastic bands, clips, Velcro®, clamps, rivets, wire, string, soldering, a sleeve, or a combination thereof.

The display 105 made of any rigid material including, but not limited to, plastic, rubber or metal. For exemplary purposes, the display is shown as being rectangular, but it may be in any shape desired. In some embodiments it is a flat surface, in other embodiments it is multi-dimensional. In some embodiments it is a standard shape such as a rectangle, circle or square. In further embodiments, the display is shaped to match the message, graphics and/or logo depicted on the display. In other embodiments, the message may be enhanced visually using three dimensional, lenticular, or reflective materials. A message, logo, or graphical image may be displayed, printed on, part of, or otherwise affixed to a first surface 115 of the display 105 facing away from the wheeled conveyance to which it is attached. In some embodiments, the display 105 may be interchanged for another display when the user desires to change the message on the display 105. In other embodiments, graphical and/or written messages may be fastened to the first surface of the display 115. In some embodiments, the graphical and/or written messages may be replaced or a new message may be put on top of an existing graphical and/or written message on the first surface of the display 115. In yet another embodiment, graphical and/or written messages may be written or printed directly on the first surface of the display 115 by the manufacturer or user. In a further embodiment, the message on the first surface of the display 115 may be displayed or altered electronically, i.e. it may be an LED, LCD, plasma or other electronic type of display. In some embodiments the display may be removable and replaceable. In other embodiments the message may be removable and replaceable. In further embodiments both the message and the display may be removable and replaceable.

Figure 2:
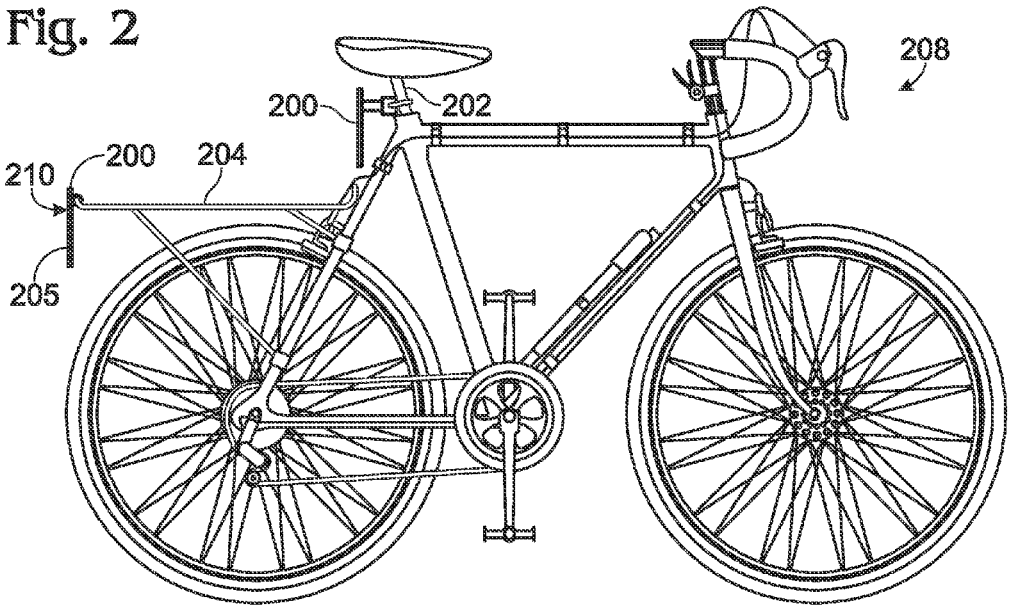
FIG. 2 shows a view of an embodiment of a display device mounted at multiple exemplary points on a bicycle.

Referring now to FIG. 2, an embodiment of the display device is shown generally at 200. The display device 200 may be attached to a seat post 202 or a luggage rack 204 of a bicycle 208, or any other attachment point. The display device 200 may be removably or permanently attached to the bicycle 208 through an attachment site (not shown) by any means generally used, including, but not limited to, nuts, pins, nails, screws, bolts, adhesives, cables, plastic ties, multi-purpose ties, tapes, elastic bands, clips, Velcro®, clamps, rivets, wire, string, soldering, a sleeve, or a combination thereof. In some embodiments, the display device 200 is attached through the use of a mounting bracket (not shown).

The display 205 may made of any rigid material including, but not limited to, plastic, rubber or metal. For exemplary purposes, the display is shown as being rectangular, but it may be in any shape desired. In some embodiments, a first surface 210 of the display is flat or substantially flat. In other embodiments, the first surface 210 of the display may be raised or three dimensional. A message, logo, or graphical image may be displayed, printed on, part of, or otherwise affixed to the first surface 210 of the display facing away from the wheeled conveyance to which it is attached. In some embodiments, the message may be enhanced visually using three dimensional, lenticular, or reflective materials. In other embodiments, the message may be created and displayed on the first surface in an electronic or digital form using for example, LED, LCD or plasma technology.

Figure 3:
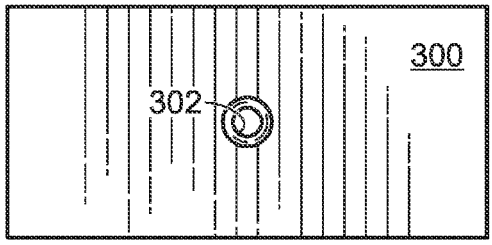
FIG. 3 shows an exemplary embodiment of a display portion of a display device.

Referring to FIG. 3, an exemplary embodiment of a display which can be attached to a mounting bracket is shown. In FIG. 3, the display 300 has a female ball socket 302 on the back of the display designed to connect with a ball plug associated with a mounting bracket. The socket 302 may be on the display as shown, or, in other embodiments, the female ball socket 302 may be on the mounting bracket and a plug may be on the display. The display 300 may be attached to a mounting bracket through any type of socket/plug or other clip combination generally used. In some embodiments, the female socket or male plug may be halves of a screw joint, pin joint, ball-and-socket joint (as shown), ball detent and socket, swivel joint, ball detent, a bolted joint, a welded joint, hirth joint, hinge, or revolute joints.

Figure 4:
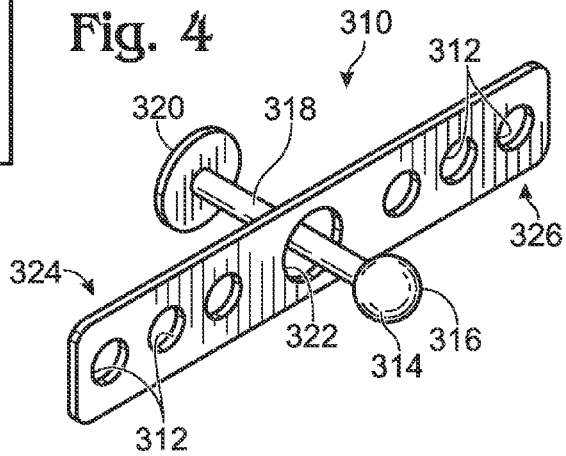
FIG. 4 shows an exemplary embodiment of a flexible mounting bracket of a display device.

An exemplary embodiment of flexible mounting bracket 310 which may be used to attach the display to the wheeled conveyance is shown in FIG. 4. The mounting bracket 310, may contain one or more apertures or attachment sites 312, including two, three, four, five, six, seven, eight or more apertures. Such apertures 312 may be any shape desired. In some embodiments they may be round as shown. In other embodiments they may be square, rectangular, oval or any other regular or irregular shape that is useful. The presence of two or more apertures allows the mounting bracket 310 to attach to different sized attachment points on a wheeled conveyance by placing a fastener or other attachment mechanism through different apertures as required by the size of the attachment point or to allow multiple fasteners to be used if desired. The mounting bracket 310 is attached to the display portion of the device using a ball half 314 of a ball and socket joint though any type of joint may be used including, but not limited to, a screw joint, pin joint, swivel joint, ball detent, a bolted joint, a welded joint, hirth joint, hinge, or revolute joint. In other embodiments, the mounting bracket may be attached to the display portion of the device using a clip such as a side release buckle, bayonet clip or other similar device including but not limited to, hooks and loop type fasteners, clasps, buckles, zippers, snaps, buttons, magnets, screws, nuts and bolts, adhesives, releasable adhesives or other suitable fasteners.

As shown in FIG. 4, the ball half 314 of the joint may comprise the ball 316, a stand 318 and a base 320. The base 320 may be any regular or irregular shape desired. In some embodiments, it is round, square, rectangular, or any other shape that will not interfere with binding the mounting bracket 310 to the attachment point. In some embodiments, the mounting bracket 310 may have a recess in which the base 320 sits so that the back of the mounting bracket 310 forms a substantially smooth surface. The ball half 314 of the joint may be threaded through an opening 322. In some embodiments, the ball half 314 of the joint may be part of the mounting bracket 310, i.e. they may be fused together. In other embodiments, they may be two separate pieces as shown. The socket and plug components that form the attachment between the display and the mounting bracket may be formed of any material generally used, including but not limited to, molded plastic, rubber or metal.

Figure 5:
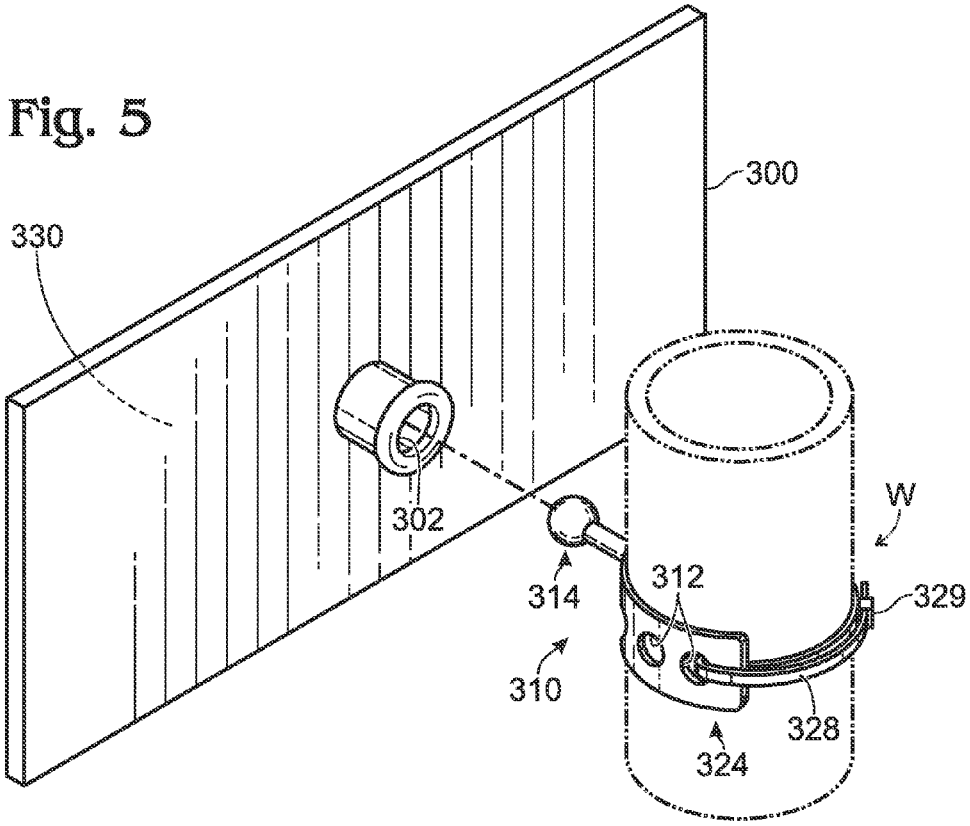
FIG. 5 shows an exploded view of an exemplary embodiment of a display device.

As shown in an exploded view of an embodiment of the display device in FIG. 5, the flexible mounting bracket 310 is wrapped around the attachment point W of the wheeled conveyance. The attachment point W of the wheeled conveyance may be any attachment point around which the mounting bracket 310 can wrap including, but not limited to, a rear windshield wiper, a front windshield wiper, a headlamp wiper, post, an antenna, seat rails, the frame, the luggage rack, or a seat post. The ends 324 and 326 of the mounting bracket 310 may be fastened by any means generally used to permanently or removably fasten such devices including but not limited to, fasteners such as nuts, pins, nails, screws, bolts, adhesives, cables, plastic ties, multi-purpose ties, tapes, zip ties, elastic bands, clips, Velcro®, clamps, rivets, wire, string, soldering, a sleeve, or a combination thereof. A fastener or attachment mechanism 328 may thread through the one or more apertures 312. In some embodiments, the mounting bracket 310 and the attachment mechanism 328 may be trimmed in order to better fit or avoid protruding material. In other embodiments, the fastener may be adjusted in order to secure the mounting bracket through a ratcheting or other mechanism 329 used to tighten fasteners. The fastener provides a secure, stable connection of the mounting bracket 310 to the attachment point such that the display will remain in place despite the movement of the wheeled conveyance or the attachment point. In some embodiments, a piece of adhesive, spacer or compressible material (not shown) may be placed between the mounting bracket 310 and the attachment point W to aid in securing the mounting bracket 310 to the wheeled conveyance.

The mounting bracket 310 attaches to the display 300 by any means applicable. As shown in FIG. 5, the mounting bracket 310 may attach to the display 300 using a joint mechanism such as a ball-and-and socket joint. In some embodiments the ball half of the joint 314 is associated with the mounting bracket 310 as shown in FIG. 4 and the socket half of the joint 302 is on the display 300 as shown in FIG. 3. In other embodiments the ball is on the display and the socket is on the mounting bracket. In further embodiments, the mounting bracket 310 attaches to the display 300 using a different type of joint including, but not limited to, a screw joint, pin joint, swivel joint, ball detent, a bolted joint, a welded joint, hirth joint, hinge, or revolute joint. In yet another embodiment, the joint may be a separate piece or pieces that attaches to the display 300 and mounting bracket 310 joining them together.

In some circumstances, it may be desirable to alter the angle of the display so that it is more easily visible while maintaining the position of the mounting bracket. In some embodiments the connection between the mounting bracket 310 and the display 300 allows the display 300 to pivot or tilt. In other embodiments, the connection between the mounting bracket 310 and the display 300 is fixed. The display 300 may pivot in one or more directions. In some embodiments it may rotate. In other embodiments it may tilt. In yet another embodiment it may pivot, rotate and/or tilt in any combination in relation to the surface of the road. The amount of rotation of the display may be any amount up to and including 360°. The display may additionally pivot or tilt +/− about 5 to +/− about 45 degrees, +/− about 5 to +/− about 40 degrees, +/− about 10 degrees to +/− about 35 degrees, +/− about 20 to +/− about 30 degrees, +/− about 10 to +/− about 20 degrees perpendicular to the road surface. In some embodiments, the display 300 may be pivoted and fixed in place by the user. In other embodiments, the display 300 may rotate to maintain the same orientation regardless of the movement of the wheeled conveyance and/or the attachment point. In additional embodiments, the display 300 may be fixed at a particular angle by the user and rotated so that it maintains the same orientation regardless of the movement of the wheeled conveyance and/or the attachment point. For example, the angle of the display 300 may be fixed using a set screw. The orientation of the display 300 may change relative to the wheeled conveyance based on the movement of the wheeled conveyance or attachment point while the angle of display and the viewability of the display to someone outside of the wheeled conveyance remains the same.

The display 300 may made of any rigid material including, but not limited to, plastic, rubber or metal. For exemplary purposes, the display is shown as being rectangular, but it may be in any shape desired. In some embodiments, a first surface 330 of the display is flat or substantially flat. In other embodiments, the first surface 330 of the display may be raised or three dimensional. A message, logo, or graphical image may be displayed, printed on, part of, or otherwise affixed to the first surface 330 of the display facing away from the wheeled conveyance to which it is attached. In some embodiments, the message may be enhanced visually using three dimensional, lenticular, or reflective materials. In other embodiments, the message may be created and displayed on the first surface in an electronic or digital form using for example, LED, LCD or plasma technology. In some embodiments, the message may be removable and the display 300 may be permanently affixed to the mounting bracket 310. In other embodiments, the message may be permanently affixed to the first surface of the display 330, but the display 300 is removable. In one embodiment, a written and/or graphical message is printed or written on the first surface of the display 330. In yet further embodiments, the display 300 and the message are removable. In yet another embodiment, a replacement message may be placed over the original message.

Figure 6:
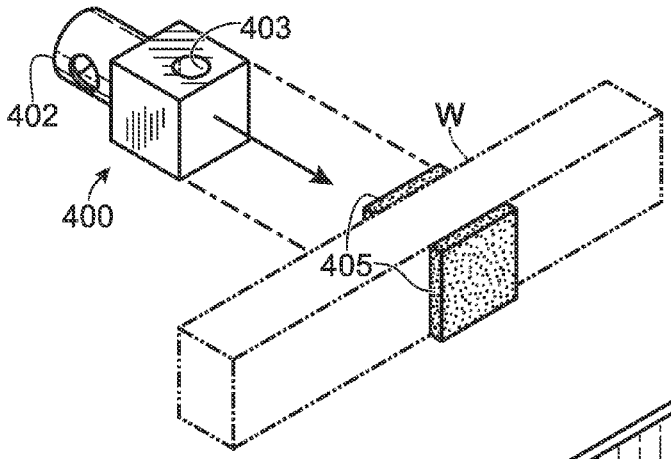
FIG. 6 shows an exemplary embodiment of a rigid mounting bracket of a display device.
Figure 7:
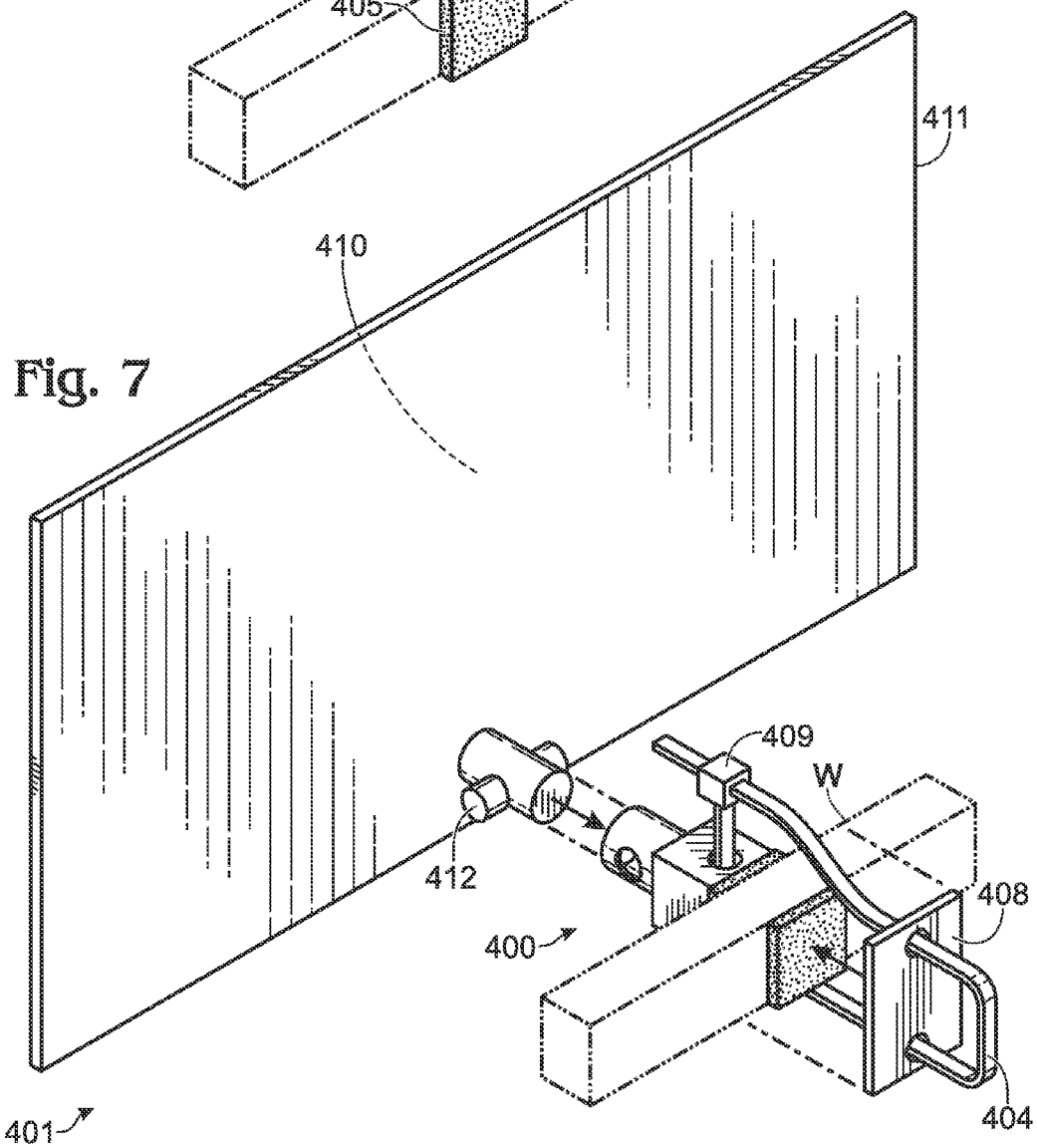
FIG. 7 shows an exploded view of an embodiment of a display device.

FIGS. 6 and 7 are an embodiment of a rigid mounting bracket (FIG. 6) and exploded view of a display device with a rigid mounting bracket (FIG. 7). The mounting bracket 400 as shown in FIG. 6 has a socket end 402 which can be used to attach it to a display 411 and an aperture or attachment site 403 through which a fastener 404 can be threaded to affix the mounting bracket to an attachment point W on a wheeled conveyance. Fasteners include, but are not limited to, nuts, screws, bolts, adhesives, cables, zip ties, plastic ties, multi-purpose ties, tapes, elastic bands, clips, Velcro®, springs, spring biased clips, clamps, rivets, wire, string, soldering, sleeve, or any combination thereof. The fastener 404 wraps around the attachment point W of the wheeled conveyance as shown in FIG. 7; in this instance, the attachment point is a rear windshield wiper arm. In some embodiments, an adhesive, spacer and/or compressible cushion 405 may placed against one or more surfaces of the attachment point W to aid in the placement and securing of the mounting bracket 400. In some embodiments, the fastener 404 may additionally thread through a backing plate 408. The fastener 404 may be tightened by any means generally used, for example a ratcheting mechanism or other tightening device 409 is used to adjust the tightness of the fastener. The fastener 404 provides a secure, stable connection of the mounting bracket 400 to the attachment point W such that the display device 401 will remain in place despite the movement of the wheeled conveyance or the attachment point. The adjustability of the fastener 404 allows the mounting bracket 400 to fasten to attachment points W of a variety of sizes. Such attachment points may be a rear windshield wiper as shown in FIGS. 6 and 7, or a post, an antenna, seat rails, the frame, the luggage rack, or seat post or other such attachment points on a wheeled conveyance.

The display 411 is attached to the mounting bracket 400 by any means generally used. As shown in FIG. 7, it may be attached using a ball detent mechanism 412. The ball detent 412 is biased to the open position, but may be compressed to allow it to connect with the socket 402 at which point it releases locking the display onto the mounting bracket 400 until released. In some embodiments, the mounting bracket 400 may attach to the display 411 using a different type of joint including, but not limited to, a screw joint, pin joint, swivel joint, bolted joint, welded joint, ball and socket joint, hirth joint, or revolute joint. In other embodiments, the display 411 and the mounting bracket 400 may be attached using a clip or buckle such as a side release buckle, bayonet clip or other similar device including but not limited to, hooks and loop type fasteners, clasps, buckles, zippers, snaps, buttons, magnets, adhesives, screws, nuts and bolts, releasable adhesives or other suitable fasteners.

For exemplary purposes, the display is shown as being rectangular, but it may be in any shape desired. For example, in some embodiments, the display shape may mimic the shape of the message, logo or graphical image. In some embodiments, a first surface 410 of the display is flat or substantially flat. In other embodiments, the first surface 410 of the display may be raised or three dimensional. A message, logo, or graphical image may be displayed, printed on, part of, or otherwise affixed to the first surface 410 of the display facing away from the wheeled conveyance to which it is attached. In some embodiments, the message may be enhanced visually using three dimensional, lenticular, or reflective materials. In some embodiments, the message may be removable and the display 411 may be permanently affixed to the mounting bracket 400. In other embodiments, a message may be permanently affixed to or part of the display, but the display 411 is removable. In yet another embodiment, both the display 411 and the message are removable. In one embodiment, a written and/or graphical message is printed or written on the display 411. In another embodiment, a replacement message may be placed over the original message. In yet another embodiment, the message may be created and displayed on the first surface of the display 410 in an electronic or digital form using for example, LED, LCD or plasma technology. In some embodiments, the display 411 may include a sleeve or channel into which a message, logo, and/or graphical image may be inserted.

The display 411 may pivot in one or more directions in relation to the wheeled conveyance. In some embodiments it may rotate. In other embodiments it may tilt in relation to the surface of the road. In yet another embodiment it may pivot, rotate and/or tilt in any combination. The amount of rotation of the display may be any amount up to and including 360°. The display may additionally tilt +/− about 5 to +/− about 45 degrees, +/− about 5 to +/− about 40 degrees, +/− about 10 degrees to +/− about 35 degrees, +/− about 20 to +/− about 30 degrees, +/− about 10 to +/− about 20 degrees perpendicular to the road surface. In some embodiments, the display 411 may be pivoted and fixed in place by the user. In other embodiments, the display 411 may rotate to maintain the same orientation regardless of the movement of the wheeled conveyance and/or the attachment point. In additional embodiments, the display 411 may be fixed at a particular angle by the user and rotate so that it maintains the same orientation regardless of the movement of the wheeled conveyance and/or the attachment point. For example, the angle of the display 411 may be fixed using, for example, a set screw. The orientation of the display 411 may change relative to the wheeled conveyance based on the movement of the wheeled conveyance or attachment point while the angle of display and the viewability of the display to someone outside of the wheeled conveyance remains the same.

Figure 9:
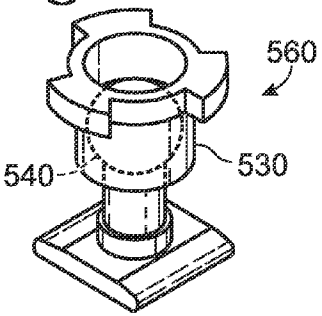
FIG. 9 shows an assembled view of an embodiment of a joint of a display device.
Figure 10:
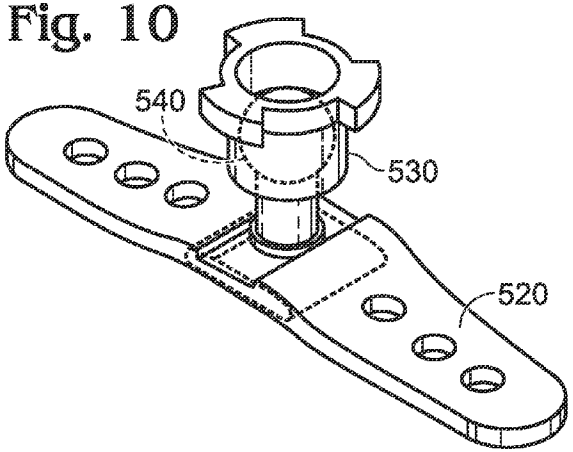
FIG. 10 shows an assembled view of an embodiment of a mounting bracket and joint of a display device.
Figure 8:
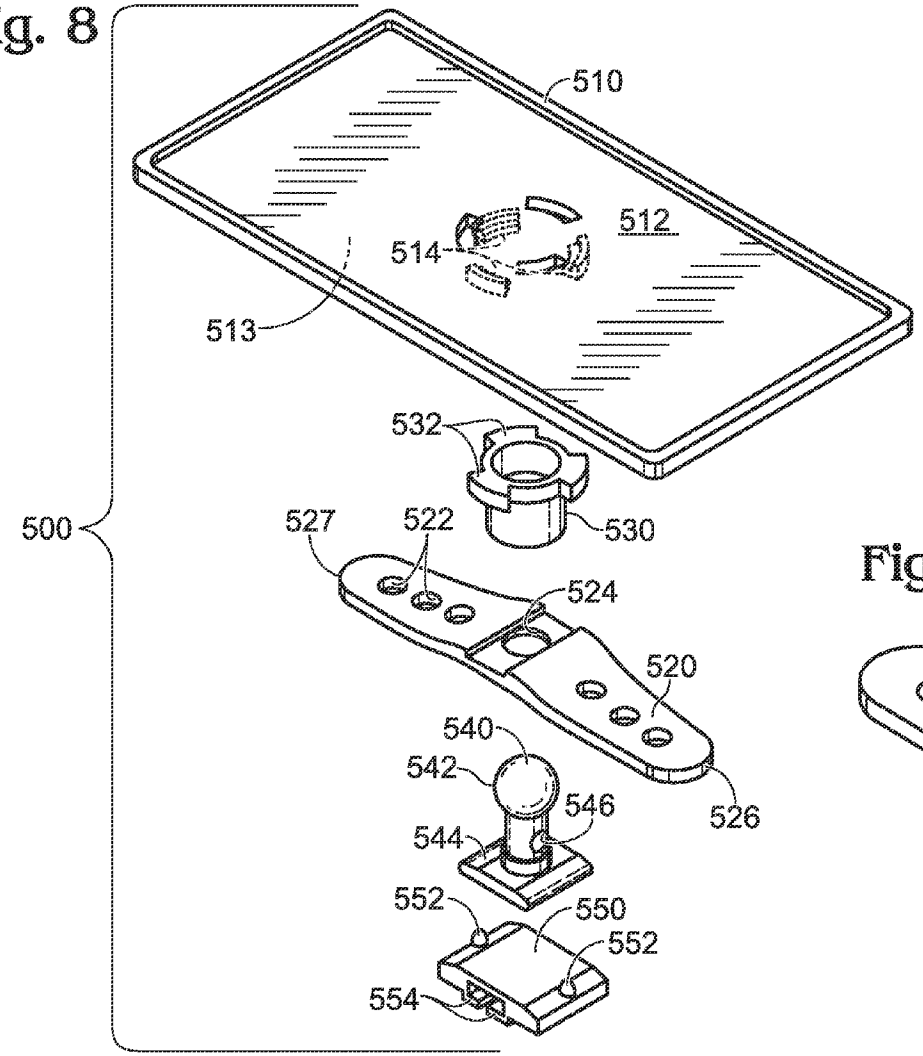
FIG. 8 shows an exploded view of an embodiment of a display device.

In another embodiment, as shown in an exploded view in FIG. 8 and assembled views in FIGS. 9 and 10, the mounting bracket 520 and the display 510 of the display device 500 are connected by a ball and socket joint 560 (FIG. 9) which are separate pieces from the display 510 and the mounting bracket 520. The socket half 530 and ball half 540 of the joint 560 may be connected to the display and/or mounting bracket in either order. For example, in some embodiments, the female part attaches to the display and the male part attaches to the mounting bracket. In other embodiments, the male part attaches to the display and the female part attaches to the mounting bracket. In yet another embodiment, one part may be permanently affixed and the other may be removably affixed, both pieces may be permanently affixed or both pieces may be removably affixed to the display or mounting bracket. In some embodiments, one piece may form part of the mounting bracket 520 or display 510 and the other part of the joint 560 may be detachable.

Turning to the exploded view 500 as shown in FIG. 8, the display 510 has a first surface 512. In some embodiments, the display 510 may have one or more first flanges 514 on the second surface 513 of the display 510 which may be used to connect a joint 560 with the display 510. The two halves of the joint 560 may be attached in any order, i.e. the socket half 530 may attach to the display 510, or the ball half 540 may attach to the display 510. As shown in FIG. 8, the socket half 530 is connected to the display. A second set of flanges 532 on the socket 530 may twist or lock into place with the first flanges 514 on the display 510. As will be evident to those of skill in the art, other means of attaching the socket 530 to the display 510 may also be used. For example, it may be attached by snapping in place, screws, adhesives, nuts, bolts, tapes, clips, fusing, or pins. In some embodiments, the separate socket and/or plug may attach to the display using a locking mechanism, for example, a screw-threaded type, a bayonet-type, or a friction lock type of locking mechanism. In some embodiments, it may be permanently attached. In other embodiments it may be removably attached.

The pieces 530 and 540 of the joint 560 may be connected as shown in FIG. 9 with the ball half 540 (male part) and the socket half 530 (female part) of a ball-and-socket joint connected to each other. The joint may be a ball detent, ball-and-socket (as shown), a screw joint, pin joint, swivel joint, bolted joint, welded joint, hirth joint, revolute joint or any type of joint generally used to connect objects.

In some embodiments, it may be desirable to lock the display 510 at a particular angle. This may be accomplished by any means generally used. In some embodiments, the ball 542 of the ball half 540 may contain small protrusions (not shown) that fit into indentations in the socket half 530 which would retain the desired angle of pivot for the display. In another embodiment, the socket half 530 may contain small protrusions (not shown) that fit into indentations in the ball 542 allowing the joint to retain the desired angle of pivot for the display. In other embodiments, a set screw (not shown) from the display to the socket 530 may fix the angle of the display device 510 relative to the ball 542, once the user has determined the desired pivot position of the display device.

The ball half 540 of the joint 560 threads through a first aperture 524 in the mounting bracket 520 to connect with the socket as shown in FIG. 10. In some embodiments, the base 544 of the ball half of the joint 540 may sit in an indentation in the mounting bracket to form a substantially flat surface with the back of the mounting bracket. The mounting bracket 520 as shown in FIGS. 8 and 10 may contain one or more second apertures or attachment sites 522 including two, three, four, five, six, seven, eight or more apertures which can be used to adjust the fit of the mounting bracket 520 onto an attachment point of a wheeled conveyance. Such apertures 522 may be of any shape desired including, but not limited to, round, square, oval, rectangular, or an irregular shape. A fastening mechanism may be threaded through one or more of the second apertures 522 to fasten the mounting bracket to the attachment point of the wheeled conveyance. In some embodiments, a fastening mechanism may be threaded through an aperture on one end of the mounting bracket 526, around the attachment point and through the other end 527 of the mounting bracket. In another embodiment, multiple fasteners may thread through an aperture 522 individually. In some embodiments, the mounting bracket may be attached to the attachment point of the wheeled conveyance by threading a fastening mechanism through an opening 546 in the joint, around the attachment point and attach to the other end of the fastener threaded through the opening 546 in the joint. Such fastening mechanisms may be multi-purpose ties, nuts, nails, pins, screws, bolts, adhesives, cables, zip ties, plastic ties, tapes, elastic bands, clips, Velcro®, clamps, rivets, wire, string, soldering, a sleeve or any combination thereof. In some embodiments, the ends 526 and 527 of the mounting bracket 520 may be trimmed for better fit.

Figures 11, 12, 13:
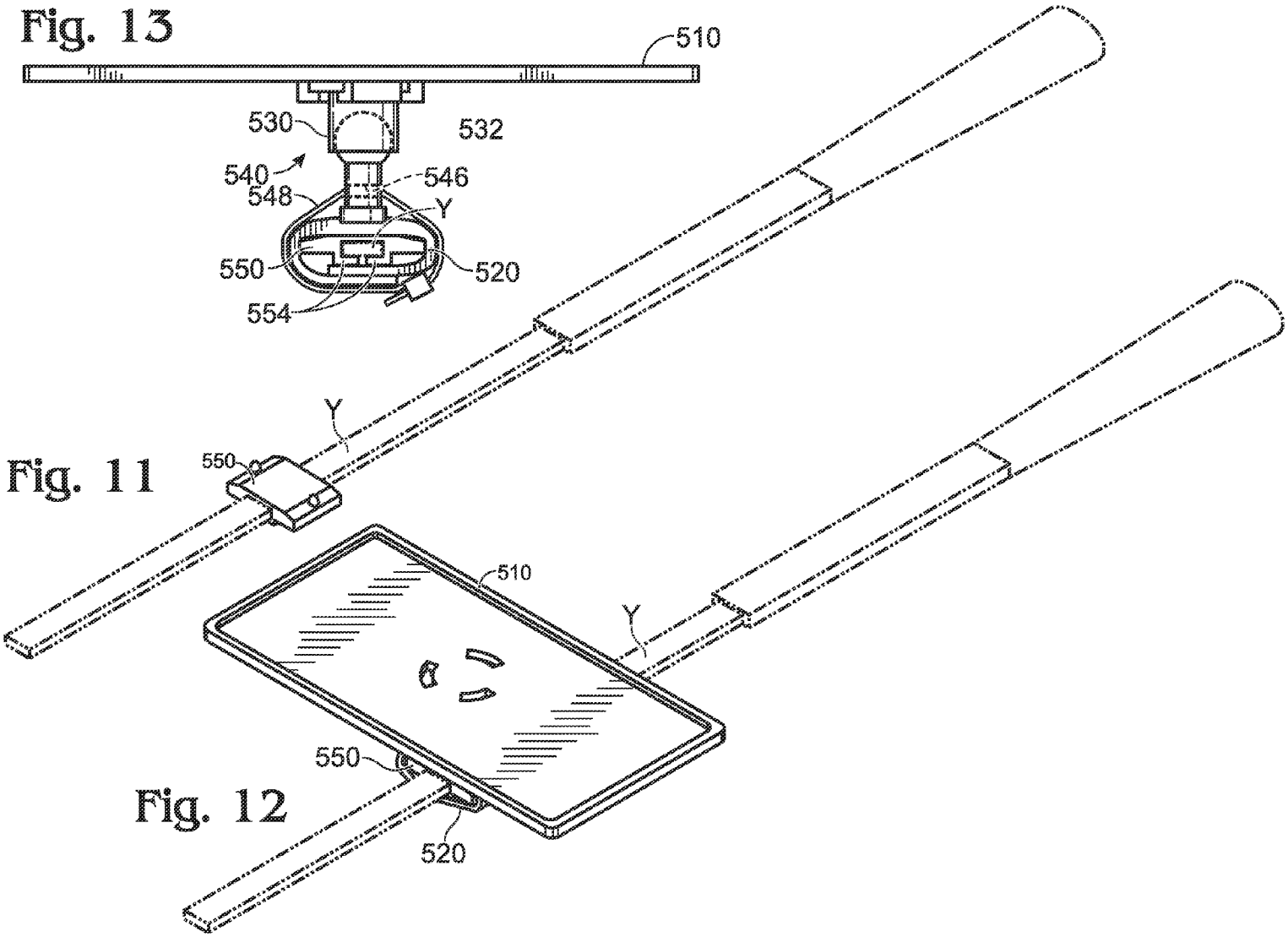
FIG. 11 shows a view of an embodiment of a spacer for use with a display device.
FIG. 12 shows a top view of an embodiment of a display device.
FIG. 13 shows a side view of an embodiment of a display device.

On some wheeled conveyances, the attachment point may be narrower than the minimum size the mounting bracket accommodates. In such a case, a spacer 550 may be used to aid in securing the mounting bracket to the attachment point. In some embodiments the spacer is permanently attached. In other embodiments, the spacer is removably attached. The spacer is seated firmly against the mounting bracket 520 by means of nubbins 552 on the spacer 550 that insert into indentations (not shown) on the underside of the mounting bracket 520. In some embodiments, the spacer attaches to the attachment point of the wheeled conveyance by means of small flaps or flexible flanges 554 on the underside of the spacer 550. As shown in FIGS. 11 and 13, the flanges 554 wrap around an attachment point Y on a wheeled conveyance attaching the spacer to the attachment point. In some embodiments the flanges 554 of the spacer 550 may be separated by a small gap.

As shown in FIG. 12, the mounting bracket 520 to which the display 510 has been attached as described above wraps around the spacer 550 fastened to an attachment point Y. The side view 13 of the same devices provides additional detail. As shown in FIG. 13, a fastener 548 may be threaded through an opening 546 in the ball half of the joint 540 instead of or in addition to threading a fastener through the mounting bracket 520. The fastener 548 may be any type generally used included, but not limited to, fasteners such as, adhesives, cables, plastic ties, zip ties, multi-purpose ties, tapes, elastic bands, clips, Velcro®, clamps, rivets, wire, string, soldering, a sleeve, or any combination thereof. As shown in FIG. 13, the fastener 548 may wrap around the mounting bracket 520 which in turn is wrapped around the spacer 550, if needed, attached to an attachment point Y.

Figure 14:
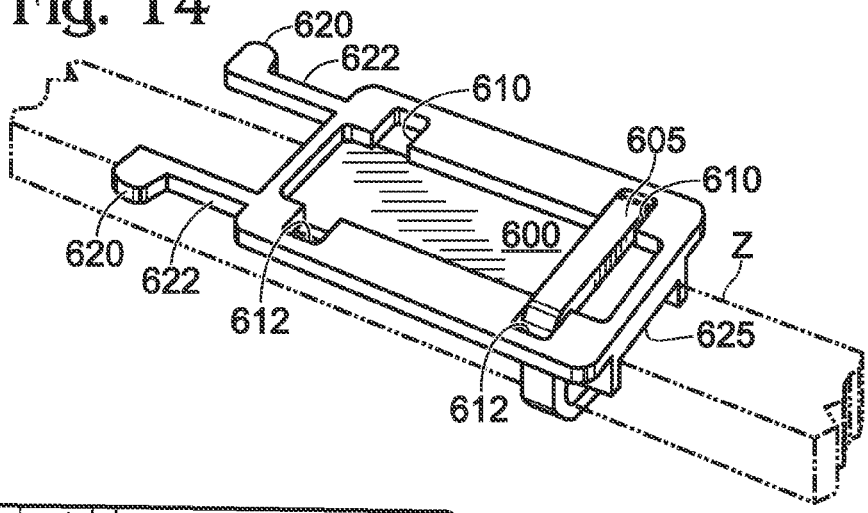
FIG. 14 shows an embodiment of an exemplary mounting bracket of a display device.
Figure 15:
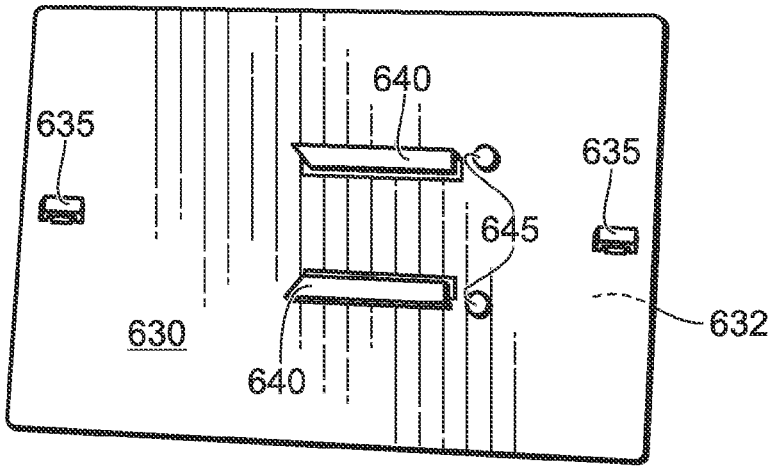
FIG. 15 shows an exemplary display of an embodiment of a display device.
Figure 16:
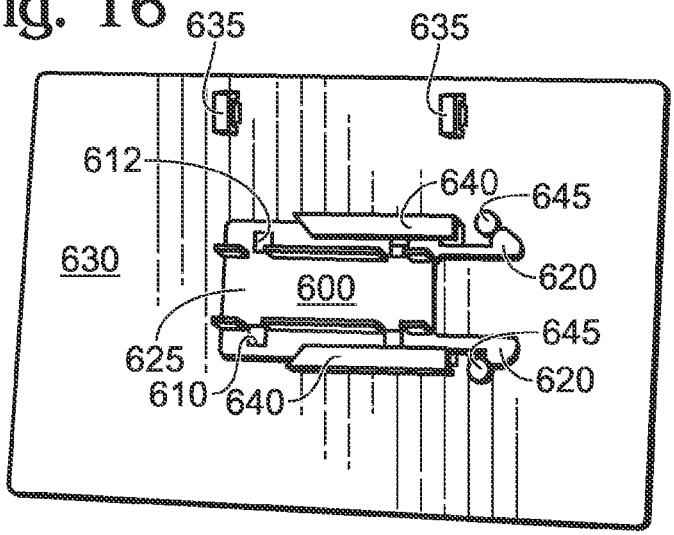
FIG. 16 shows an assembled view of an embodiment of a display device.

FIG. 14 depicts another embodiment of a mounting bracket 600 for a display device. The mounting bracket 600 comprises a bayonet clip, side release buckle or other quick release clip. The exemplary clip in FIG. 600 has spring arms 622 biased to the out position. When depressed, the spring arms 622 can slide into rails on the display 640 as shown in FIG. 15 and lock in place as shown in FIG. 16. In some embodiments, the two spring arms 622 may have a retaining block 620 that terminates on the front end and helps lock the arms in place. In other embodiments, the retaining block on the spring arms may lock around a stop mechanism 645 at a first end of the rails 640 on the display. The mounting bracket 600 sits on an attachment point Z of the wheeled conveyance using a groove 625. The mounting bracket 600 is fastened to the attachment point Z of the wheeled conveyance using one or more fasteners 605. The fasteners 605 may be any type generally used included, but not limited to, fasteners such as, adhesives, cables, plastic ties, zip ties, multi-purpose ties, tapes, elastic bands, clips, Velcro®, clamps, rivets, wire, string, soldering, a sleeve, or any combination thereof. The fastener is threaded through an aperture or attachment site 610, wrapped around the attachment point Z of the wheeled conveyance and threaded through the opposite aperture or attachment site 612 or vice versa. The mounting bracket 600 is shown with two pairs of apertures 610 and 612 for exemplary purposes. In some embodiments, the device may have one, two, three, four or more pairs of apertures or attachment sites which may be used to attach the mounting bracket at the attachment point Z of the wheeled conveyance.

As shown in FIG. 15, the display 630 comprises two slides or rails 640 for use in attaching to the mounting bracket. In some embodiments, the display may further comprise one or more stops 645 to hold the clip portion of the mounting bracket in place and one or more additional attachment sites 635 to assist in attachment to attachment point Z. Attachment sites 635 may be located on the same or different sides of the display. For example, they may be on opposite sides of the back of the display as shown in FIG. 15, or on the same side of the back of the display as shown in FIG. 16. In some embodiments, the display 630 is attached using the attachment sites 635 without the mounting bracket 600, i.e. a first end of a fastener is threaded through a first attachment site 635, around an attachment point Z and then the first end of the fastener and a second end of the fastener are fastened together, holding the display 630 in place on the attachment point Z or a single fastener may be threaded through both attachment points 635, around an attachment point Z and then the ends of the fastener fastened together (not shown).

As shown in FIG. 16, the mounting bracket 600 slides between the rails 640 on the display 630, locking into place and holding the display 630 securely to the attachment point. A written and/or graphical message may be displayed on or affixed to the side 632 of the display 630 facing away from the wheeled conveyance to which it is attached. For exemplary purposes, the display is shown as being rectangular, but it may be in any shape desired. For example, all or part of the display may be in the shape of the message, logo or graphical image to be displayed. In some embodiments, the message may be enhanced visually using three dimensional, lenticular, or reflective materials. In some embodiments, the message may be removable and the display 630 may be permanently affixed to the mounting bracket 600. In other embodiments, message may be permanently affixed to or part of the display, but the display 630 is removable. In yet another embodiment, both the display 630 and the message are removable. In one embodiment, a written and/or graphical message is printed or written on the display 630. In another embodiment, a replacement message may be placed over the original message. In yet another embodiment, the message may be created and displayed on the display 630 in an electronic or digital form using for example, LED, LCD or plasma technology. In some embodiments, the display 630 may include a sleeve or channel into which a message, logo, and/or graphical image may be inserted.

Figure 17:
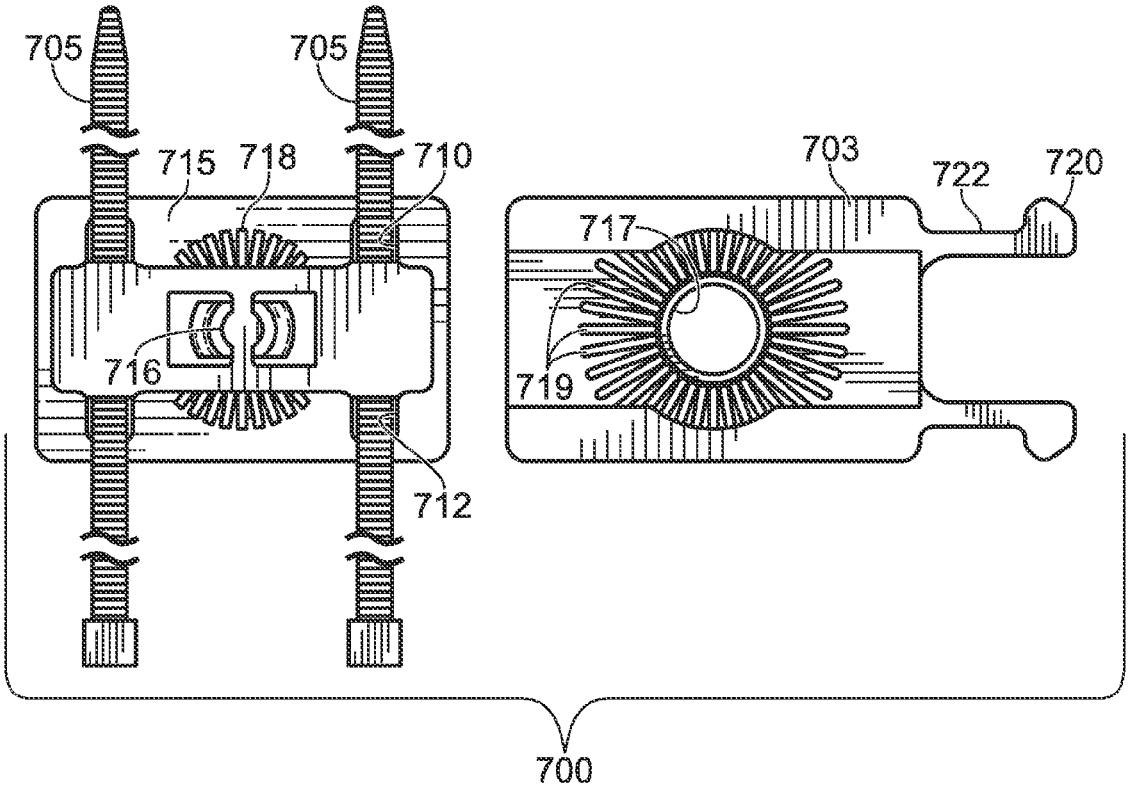
FIG. 17 shows an embodiment of the parts of an exemplary mounting bracket of a display device.
Figure 19:
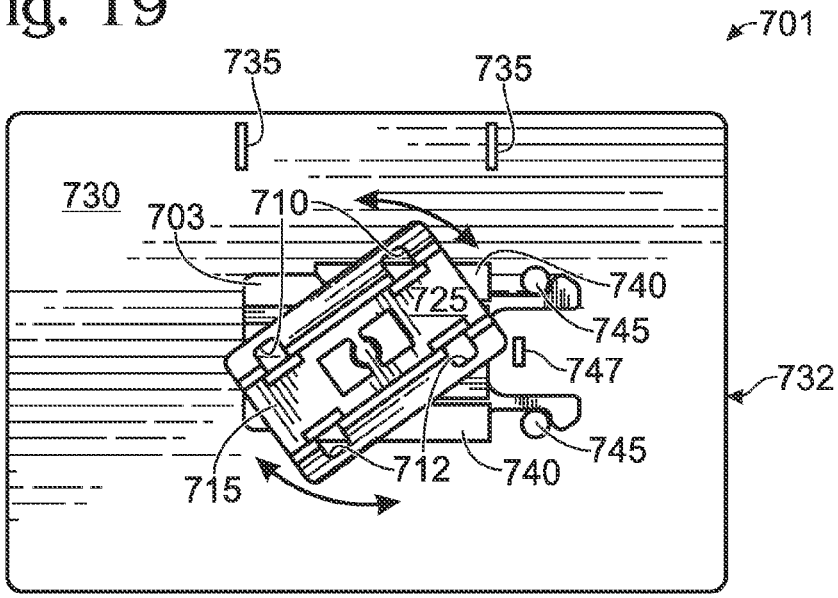
FIG. 19 shows an assembled view of an embodiment of a display device.
Figure 18:
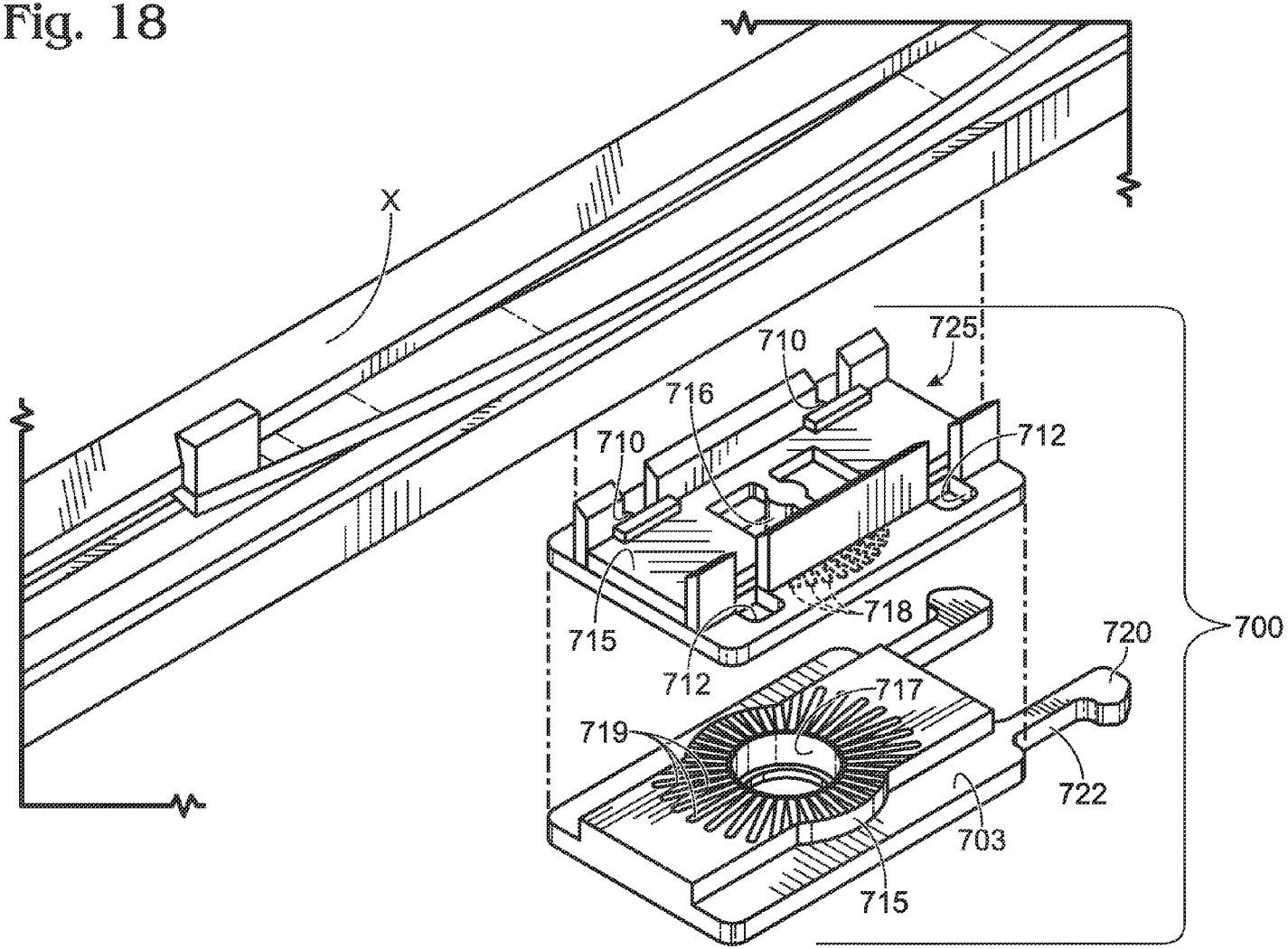
FIG. 18 shows an exploded view of an embodiment of an exemplary mounting bracket of a display device and an attachment point.

FIGS. 17-19 depict another embodiment of a mounting bracket 700 for a display device 701. As shown in FIG. 17, the mounting bracket 700 comprises two pieces, a first part 703 comprising a bayonet clip, side release buckle, quick release clip, or other useful buckle or clip. And a second part 715 which is used to attach the mounting bracket 700 to a windshield wiper or other attachment point on a vehicle. The mounting bracket is designed to attach to the second opposite side of a display 730 in order to present a message on a first side of a display 732 which is visible to someone not riding in or on the vehicle as shown in FIG. 19.

Turning to FIG. 17 and the mounting bracket 700, in some embodiments the first part of the mounting bracket 703 comprises spring arms 722 biased to the out position. In some embodiments, the spring arms 722 further comprise a retaining block 720. The first part of the mounting bracket 703 additionally comprises a grooved interface 719 for controlled rotation between the first part 703 and the second part 715 as seen in FIGS. 18 and 19. Such grooved interface 719 and its toothed companion 718 allow the first part 703 and the second part 715 to rotate in a controlled fashion in the same plane in relation to each other, i.e. clockwise or counterclockwise. The grooved interface 719 and its toothed companion 718 may be on the on the first part 703 and the second part 715 as shown in FIG. 17 or may reversed such that the toothed interface is on the first part 703 and the grooved interface is on the second part 715 (not shown). The two pieces 703 and 715 are attached by any means generally used such that the first piece 703 and the second piece 715 can rotate between about 45°, to about 90°, to about 180°, to about 360° clockwise and counterclockwise in relation to each other. In some embodiments, the second piece 715 and the first piece 703 are connected by a male part 716 and a female socket 717 as shown in FIG. 17 and FIG. 18.

The two parts of the mounting bracket 700 act together to secure the display 730 to the attachment point X as shown in FIG. 18. The first and second parts of the mounting bracket 703 and 715 respectively are rotated using the toothed interface 718 and 719 by at least 45°, more preferably about 90° relative to each other so that apertures 710 and 712 are clear. The initiation of the rotation is shown in FIG. 19. The rotation through the grooved interface 719 and its toothed companion 718 facilitates the threading of fasteners 705 through the aperture or attachment site 710 and the opposite aperture or attachment site 712 of the second part of the mounting bracket 715 or vice versa as seen in FIG. 17. The fasteners 705 may be any type generally used included, but not limited to, fasteners such as, adhesives, cables, plastic ties, zip ties, multi-purpose ties, tapes, elastic bands, clips, Velcro®, clamps, rivets, wire, string, soldering, a sleeve, or any combination thereof. Once the fasteners are threaded through the apertures 710 and 712, the first and second parts 703 and 715 of the mounting bracket 700 are then rotated either clockwise or counterclockwise using the toothed interface 718 and 719 so that the first part 703 and the second part 715 of the mounting bracket 700 are once again parallel to each other as shown in FIG. 18. The mounting bracket 700 is then placed on the attachment point X such that the attachment point fits in the groove 725 of the mounting bracket 700. In some embodiments, a piece of adhesive, for example double sided tape, may be placed in the groove as well to aid in attaching the mounting bracket 700 to the mounting bracket if desired. The fasteners 705 are then connected around the attachment point X, and tightened into place, locking the mounting bracket 700 onto the attachment device. The display 730 may be attached to the mounting bracket before or after the mounting bracket 700 is attached to the attachment point X.

As shown in FIG. 19, the opposite side of the display member 730 comprises two slides or rails 740 for use in attaching to the mounting bracket. In some embodiments, the display may further comprise one or more stops 745 to hold the clip portion of the mounting bracket in place and one or more additional attachment sites 735 to assist in attachment to attachment point X. In order to attach the mounting bracket 700 to the display member 730, the spring arms 722 of the mounting bracket 700 are depressed to slide into rails 740 on the display 730. Once through the rails, the spring arms return to the outward position locking the mounting bracket in place on the display. In some embodiments, the two spring arms 722 may have a retaining block 720 that terminates on the front end and helps lock the arms in place around a first stop mechanism 745 at a first end of the rails 740 on the display 730. In additional embodiments, the display member 730 may have a second stop mechanism or retaining block 747 between a first end of the rails 740 as shown in FIG. 19 that prevents the mounting device 700 from sliding too far forward.

Attachment sites 735 may be used to attach the display 730 to an attachment point that is larger than the groove 725 on the mounting bracket 700 or which are ill-suited to the use of the groove 725. Attachment sites 735 may be located on the same or different sides of the back of the display 730. In some embodiments, the display 730 is attached using the attachment sites 735 without the mounting bracket 700, i.e. a first end of a fastener 705 is threaded through a first attachment site 735, around an attachment point X and then the first end of the fastener 705 and a second end of the fastener are fastened together, holding the display 730 in place on the attachment point X or a single fastener may be threaded through both attachment points 735, around an attachment point X and then the ends of the fastener fastened together (not shown).

A written and/or graphical message may be displayed on or affixed to the first side 732 of the display 730 facing away from the wheeled conveyance to which it is attached. For exemplary purposes, the display is shown as being rectangular, but it may be in any shape desired. For example, all or part of the display may be in the shape of the message, logo or graphical image to be displayed. In some embodiments, the message may be enhanced visually using three dimensional, lenticular, or reflective materials. In some embodiments, the message may be removable and the display 730 may be permanently affixed to the mounting bracket 700. In other embodiments, message may be permanently affixed to or part of the display, but the display 730 is removable. In yet another embodiment, both the display 730 and the message are removable. In one embodiment, a written and/or graphical message is printed or written on the display 730. In another embodiment, a replacement message may be placed over the original message. In yet another embodiment, the message may be created and displayed on the display 730 in an electronic or digital form using for example, LED, LCD or plasma technology. In some embodiments, the display 730 may include a sleeve or channel into which a message, logo, and/or graphical image may be inserted.

While the instant invention has been shown and described herein in what are conceived to be the most practical and preferred embodiments, it is recognized that departures may be made therefrom within the invention, which is therefore not to be limited to the details disclosed herein, but is to be afforded the full scope of the claims so as to embrace any and all equivalent apparatus and articles. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list.

All publications and patents cited herein are incorporated herein by reference for the purpose of describing and disclosing, for example, the materials and methodologies that are described in the publications, which might be used in connection with the presently described invention. The publications discussed above and throughout the text are provided solely for their disclosure prior to the filing date of the present application. Nothing herein is to be construed as an admission that the inventors are not entitled to antedate such disclosure by virtue of prior invention.

What is claimed is:

1. A display device for attachment to a wheeled conveyance, wherein the display device comprises:

a substantially flat, rigid display member comprising:

a printed message on a first surface; and rails on a second opposite surface;

a mounting bracket that attaches to the display member using the rails;

wherein the mounting bracket comprises:

a first part and a second part that can rotate in relation to each other using a paired grooved and toothed interface; and spring arms biased to an out position.

2. The display device of claim 1, wherein the display device further comprises a means for attaching the mounting bracket to the wheeled conveyance.

3. The display device of claim 2, wherein the means for attaching the mounting bracket to the wheeled conveyance is adjustable.

4. The display device for claim 1, wherein the display device can be easily removed from the wheeled conveyance.

5. The display device for claim 1, wherein the display device is attached to a rear windshield wiper of a car or truck.

6. The display device of claim 1, wherein the mounting bracket is rigid.

7. The display device of claim 1, wherein the mounting bracket is a side release clip.

8. The display device of claim 1, wherein the rigid display may be interchanged with a second rigid display.

9. The display device of claim 1, wherein the spring arms have a retaining block at a first end.

10. The display device of claim 1, wherein the display member has an independent first stop at a first end of the rails.

11. The display device of claim 10, wherein the display member has a second stop between the first end of the rails.

12. The display device of claim 1, wherein the mounting bracket has a groove to assist in placement of the display device on the wheeled conveyance.

13. The display device of claim 12, wherein the groove in the mounting bracket further comprises a piece of adhesive.

* * * * *